United States Patent [19]

Barakitis

[11] Patent Number: 4,970,425

[45] Date of Patent: Nov. 13, 1990

[54] THERMAL DEVICE, MOUNT, AND MANUFACTURING METHOD

[75] Inventor: Nikolaos Barakitis, Salem, Mass.

[73] Assignee: GTE Products Corporation, Danvers, Mass.

[21] Appl. No.: 342,063

[22] Filed: Apr. 24, 1989

[51] Int. Cl.[5] ..... H01J 1/88; H01J 61/64

[52] U.S. Cl. ..... 313/39; 313/146; 313/619; 313/623

[58] Field of Search ..... 313/623, 624, 625, 619, 313/39, 42, 43, 146

[56] References Cited

U.S. PATENT DOCUMENTS 4,843,282 6/1989 Barakitis et al. ..... 313/619

*Primary Examiner*—Kenneth Wieder

*Attorney, Agent, or Firm*—Carlo S. Bessone

[57] ABSTRACT

A thermal device, such as a glow discharge starter, includes an hermetically sealed envelope containing an ionizable medium, a bimetallic electrode having a bimetallic element associated therewith, and a counter electrode. A mount sealed in the envelope includes a glass stem having a disk-shaped portion extending substantially across the envelope and a longitudinally-extending planar portion. The transverse portion of the mount assists in centering the electrodes within the envelope and preventing the bimetallic element from oxidizing during the manufacturing process when the mount is sealed to the envelope. Preferably, the transverse portion is disk-shaped having a radius within the range of from about 89 t0 93 percent of the internal radius of the envelope. The defined thickness of the planar portion of the glass stem allows rapid transfer of heat during sealing so that the planar portion can effectively be sealed to the envelope without developing seal cracks.

16 Claims, 4 Drawing Sheets

THERMAL DEVICE, MOUNT, AND MANUFACTURING METHOD

FIELD OF THE INVENTION

This invention relates in general to thermal devices (i.e., glow discharge starters and thermal protectors) and pertains more particularly, to a mount for use in these devices and also to a method of manufacturing both the thermal device and the mount.

BACKGROUND OF THE INVENTION

A glow discharge starter is usually connected across or in parallel with an arc discharge lamp and contains a pair of electrodes. At least one of the electrodes comprises a bimetallic element which, when heated as a result of the glow discharge, bends towards the other electrode When contact is made, the glow discharge ceases causing the bimetallic element to cool and withdraw from the contacted electrode. When contact is broken, a voltage pulse induced by the induction of the ballast, appears across the opposed electrodes of the lamp thereby initiating an arc discharge within the lamp. If the lamp ignition does not occur after the first voltage pulse, the glow discharge sequence is repeated until lamp ignition occurs.

Various glow discharge starters and other thermal devices are manufactured by first sealing a glass mount to a piece of glass tubing (i.e., envelope) by means of a press seal. The mount supports the electrodes of the device. Often during the manufacturing process, the press sealing operation causes the axis of the electrodes to be angled (i.e., misaligned) with respect to the tubing. If this misalignment is great enough, either the bimetallic electrode or the counter electrode touch the internal surface of the glass tubing. Consequently, the electrical characteristics of the glow discharge starter are altered.

The heat and gases from the sealing fires used during the Press sealing operation flow upwards through the glass tubing between the stem of the mount and the internal surface of the glass tubing in a so-called "chimney effect". As a result, the surface of the bimetallic element is unwantonly oxidized.

The lower portion of the glass stem which is sealed to the glass tubing is relatively thick which often prevents this section of the stem from reaching the proper sealing temperature. Consequently, thermal cracks often appear in the region of the press seal. Increasing the sealing fires in an effort to adequately heat the lower portion of the stem has a two-fold effect. First, the increased heat is transferred upwards through the stem causing softening of the entire stem. At the same time, the sealing heat causes the bimetallic element to press against the counter electrode Because of the softened stem, the bimetallic element causes a permanent distortion in the parallel relationship of the electrodes. Second, the increased heat further increases the amount of oxidation on the bimetallic element

SUMMARY OF THE INVENTION

It is, therefore, an object of the present invention to obviate the disadvantages of the prior art.

It is still another object of the invention to provide an improved thermal device wherein the electrodes are properly oriented with respect to the envelope so that the electrodes do not touch the internal surface of the envelope.

It is another object of the invention to provide an improved method for manufacturing a thermal device whereby the oxidation on the bimetallic element is eliminated.

It is still another object of the invention to provide a method which eliminates softening of the glass stem so that the bimetallic element does not press against the counter electrode causing distortion in the parallel relationship of the electrodes.

It is another object of the invention to provide a novel method of manufacturing a mount for use in a thermal device.

These objects are accomplished in one aspect of the invention by the provision of a thermal device comprising an envelope having a predetermined internal radius. A mount within the envelope includes a glass stem sealed to one end of the envelope and a pair of lead-in conductors passing through the glass stem and forming a bimetallic electrode and a counter electrode within the envelope The glass stem includes a transverse portion extending substantially across the envelope and having a predetermined radius and a longitudinally-extending planar portion projecting from the transverse portion. The transverse portion is sufficient to eliminate the formation of oxide on the bimetallic electrode during sealing.

In accordance with further aspects of the present invention, the predetermined radius of the transverse portion of the glass stem is preferably within the range of from about 89 to 93 percent of the predetermined internal radius of the envelope. In a preferred embodiment, the transverse portion of the glass stem is disk-shaped portion and lies in a plane substantially perpendicular to the lead-in conductors.

In accordance with still further teachings of the present invention, the planar portion of the glass stem has a pair of substantially parallel surfaces spaced a predetermined distance thereapart and lying in respective planes parallel to a plane passing through the lead-in conductors. Preferably, the predetermined distance between the pair of substantially parallel surfaces is not greater than about four times the diameter of the portion of the lead-in conductors associated with the planar portion of the glass stem.

The objects mentioned above are accomplished in another aspect of the invention by the provision of a method of manufacturing a thermal device comprising the steps of providing an envelope and forming a mount. The mount is formed by providing a pair of lead-in conductors, forming a glass bead on the lead-in conductors, heating the glass bead to the softening point of the glass, providing a means for forming the glass bead into a stem having a transverse portion and a planar portion projecting from the transverse portion, moving the forming means to engage the softened glass bead, and removing the forming means from the mount. The mount is sealed to the envelope. The envelope is exhausted and hermetically sealed.

Additional objects, advantages and novel features of the invention will be set forth in the description which follows, and in part will become apparent to those skilled in the art upon examination of the following or may be learned by practice of the invention. The aforementioned objects and advantages of the invention may be realized and attained by means of the instrumentalities and combination particularly pointed out in the appended claims.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims in connection with the above-described drawings.

Figure 1:
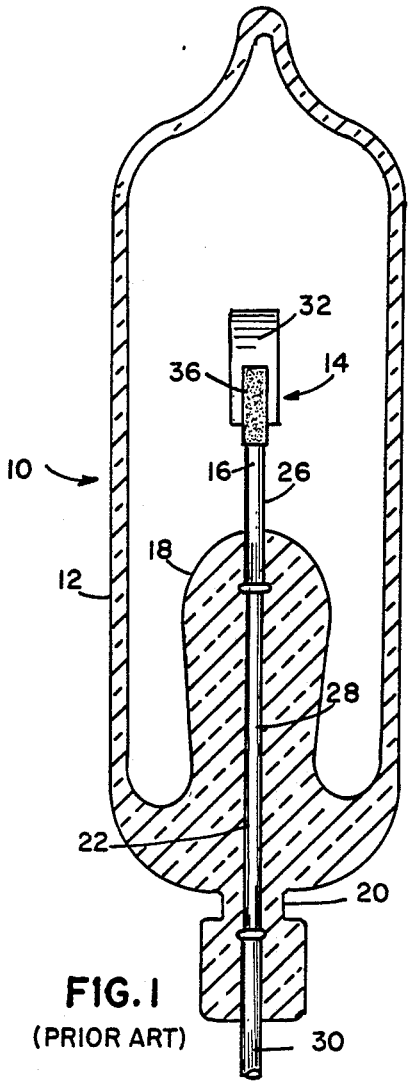
FIG. 1 (PRIOR ART)
FIG. 1 represents a sectional, side elevational view of a prior art glow discharge starter.
Figure 2:
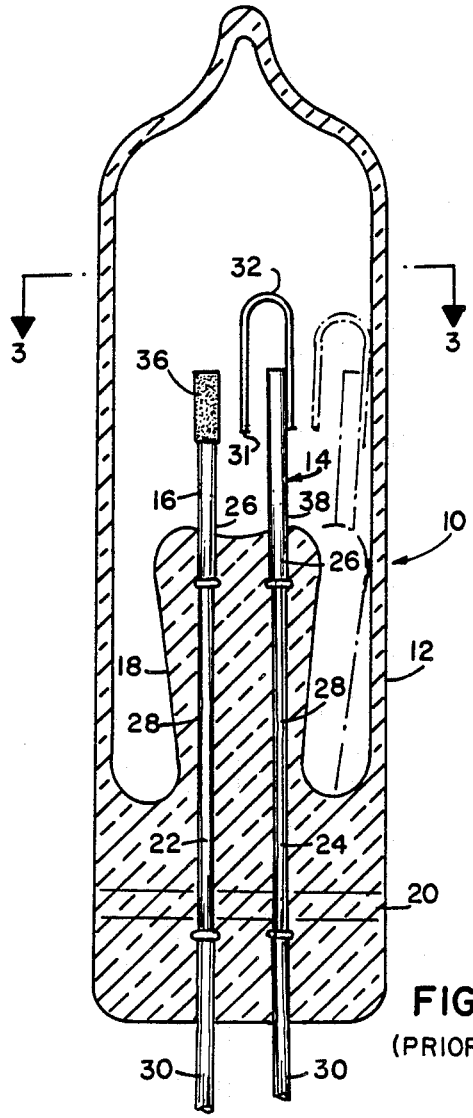
FIG. 2 (PRIOR ART)
FIG. 2 is a sectional, front elevational view of the glow discharge starter of FIG. 1.
Figure 3:
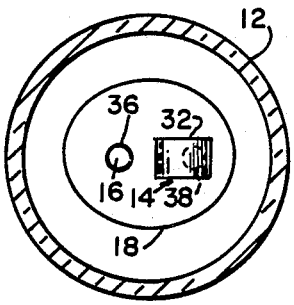
FIG. 3 (PRIOR ART)
FIG. 3 is a top elevational view of the glow discharge starter in FIG. 2 taken along the line 3—3.

Referring now to the drawings with greater particularity, there is shown in FIGS. 1–3 a glow discharge starter of the prior art. Glow discharge starter 10 comprises an hermetically sealed tubular-shaped envelope 12 containing an ionizable medium. The ionizable medium may comprise an inert gas or combinations thereof at a low pressure typically within the range of from about 12.0 torr to about 18.0 torr. A bimetallic electrode 14 and a counter electrode 16 are located within envelope 12 and sealed in glass stem 18. During the manufacturing of the thermal device, glass mount is hermetically sealed by means of a press seal 20 located at one end of envelope 12.

Electrodes 14 and 16 are electrically connected to or as illustrated in FIG. 1, formed from segmented lead-in conductors 24 and 22, respectively. Lead-in conductors 22 and 24 consist an upper nickel/iron segment 26, an intermediate "Dumet" segment 28 and a lower copper segment 30. Bimetallic electrode 14 includes a post 38 and a bimetallic element 32. Bimetallic element 32 includes a free end 31 and consists of two strips of metal having different linear coefficients of expansion welded together. The side of lower expansion is formed of a nickel-steel alloy while the side of higher expansion is formed of chrome iron. In FIGS. 1–3, the side of higher coefficient of expansion is on the outside (i.e., the side away from counter electrode 16) such that the free end 31 of bimetallic element 32 engages counter electrode 16 upon flexure of bimetallic element 32. The other end of bimetallic element 32 is secured to post 38 by welding.

A coating 36 of lanthanum is disposed on a portion of counter electrode 16.

During formation of press seal 20, the axis of the mount often becomes angled with respect to the axis of the envelope as indicated by the dashed lines in FIG. 2 causing either the bimetallic electrode (as shown in FIG. 2) or the counter electrode to touch the internal surface of the glass tubing. As a result, the electrical characteristics of the glow discharge starter are altered. Also, the heat and gases from the press sealing fires flow upwards through the glass tubing in the region between glass stem 18 and the internal surface glass tubing 12 in a so-called "chimney effect". As a result, the surface of the bimetallic element is oxidized.

Figure 4:
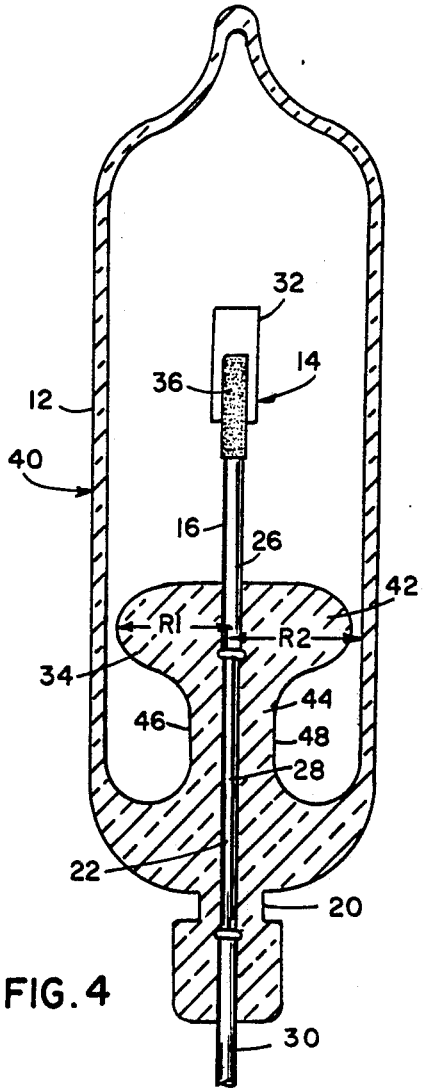
FIG. 4 represents a sectional, side elevational view of a glow discharge starter according to the present invention.
Figure 5:
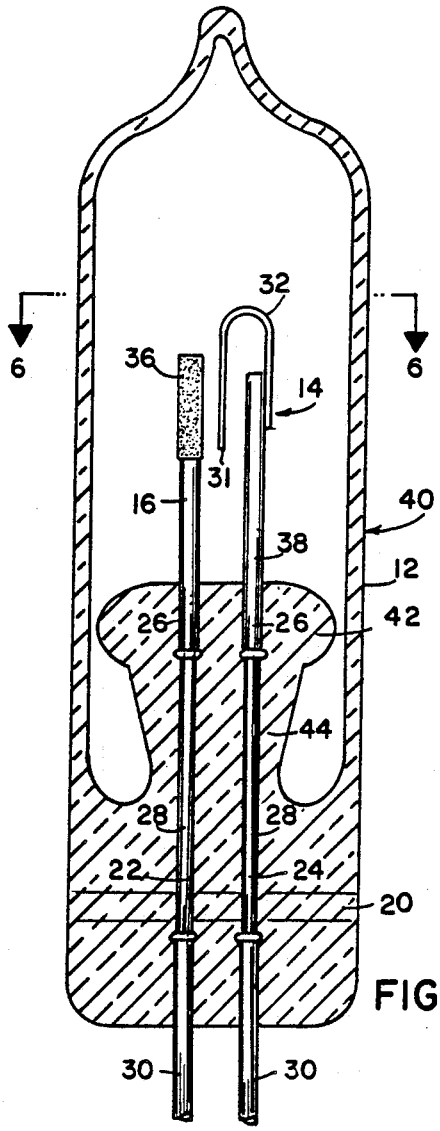
FIG. 5 is a sectional, front elevational view of the glow discharge starter of FIG. 4.
Figure 6:
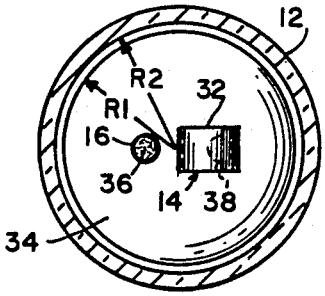
FIG. 6 is a top elevational view of the glow discharge starter in FIG. 2 taken along the line 3—3.

FIGS. 4–6 represent an embodiment of a glow discharge starter made in accordance with the teachings of the present invention. Elements similar to those shown in FIGS. 1–3 are indicated with identical numerals. Glow discharge starter 40 includes an envelope 12 having an internal radius R2 (FIGS. 4 and 6) and a T-shaped glass stem 34. Glass stem 34 includes a transverse portion such as disk-shaped portion 42 extending substantially across envelope 12. Disk-shaped member 42 lies in a plane substantially perpendicular to lead-in conductors 22, 24 and has a radius R1 (FIGS. 4 and 6). A longitudinally-extending planar portion 44 projects from a lower surface of disk-shaped portion 42.

Disk-shaped portion 42 significantly reduces the flow of heat and gases from the press sealing fires and allows the bimetallic element to remain cooler during sealing. Consequently, the bimetallic element does not oxidize.

Having a disk radius R1 equal to the internal tube radius R2 may hinder insertion of the mount into the envelope during high-speed assembly. Therefore, radius R1 of disk-shaped portion 42 is preferably within the range of from about 89 to 93 percent of the internal radius R2 of envelope 12. The radius R1 of transverse portion 42 is large enough to reduce the "chimney effect" enough to eliminate the formation of oxidation on the bimetallic element.

In addition to eliminating oxidation of the bimetallic element, the transverse portion improves alignment of the electrode by centering the mount and preventing the electrodes from touching the internal surface of the tubing. Other shapes may be useful in improving the alignment of the electrodes within the tubing. For example, the upper portion of the stem may have a square shape.

Planar portion 44 of qlass stem 34 is provided with a pair of substantially parallel surfaces 46, 48 spaced a predetermined distance thereapart. Parallel surfaces 46, 48 lie in respective planes parallel to a plane passing through the two lead-in conductors 22, 24.

Preferably, the distance between the pair of substantially parallel surfaces 46, 48 is not greater than about four times the diameter of portion 28 of the lead-in conductors associated with the planar portion of the glass stem.

The relatively thin planar portion reduces the occurrence of seal cracks since during sealing the planar portion can more quickly reach the proper temperature for sealing. Moreover, the planar portion is substantially thinner than the transverse portion so that the heat from the sealing fires is not transferred upwards through the stem enough to cause softening of the entire stem and permanent distortion in the parallel relationship of the electrodes.

Figure 7:
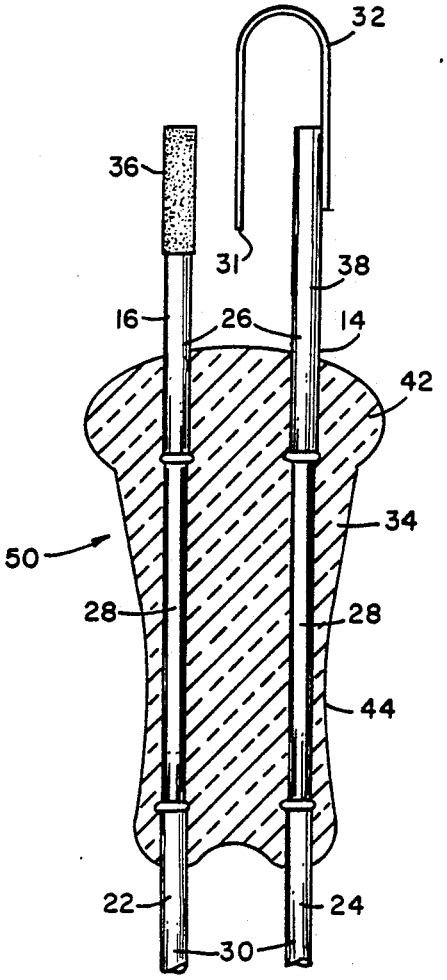
FIG. 7 is a front elevational view of a mount according to the teachings of the present invention.
Figure 8:
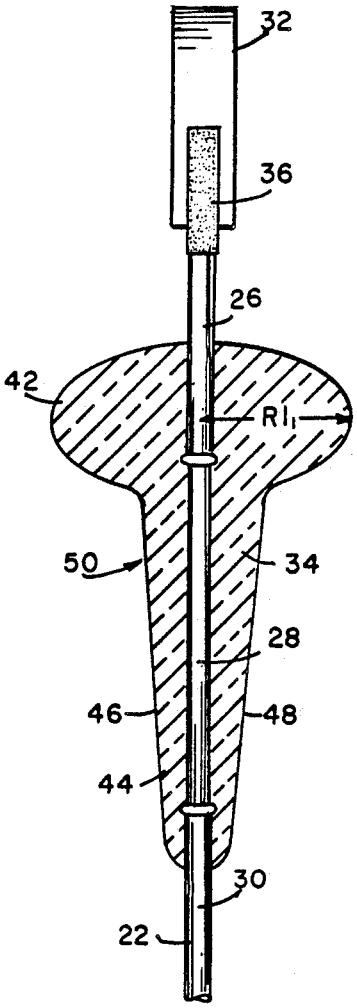
FIG. 8 is a side elevational view of the mount in FIG. 7.
Figure 9:
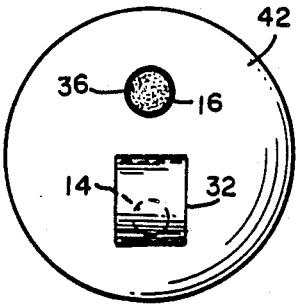
FIG. 9 is a top plan view of the mount in FIG. 8.

FIGS. 7–9 illustrate a mount 50 (prior to sealing to an envelope) made in accordance with the teaching of the present invention. Mount 50 includes lead-in conductors 22 and 24 sealed in and supported by glass stem 34. A bimetallic element 32 is welded to one end of lead-in conductor 24 to form bimetallic electrode 14. A coating 36 of lanthanum is disposed on the remote end of lead-in conductor 22. Glass stem 34 includes a disk-shaped transverse portion 42 and a longitudinally-extending lower planar portion 44 projecting from a surface of disk-shaped portion 42. To improve sealing, lower planar portion 44 extends to copper portion 30 so that the entire "Dumet" portions 28 of lead-in conductors 22, 24 are covered with glass.

Figures 10A, 10B, 10C:
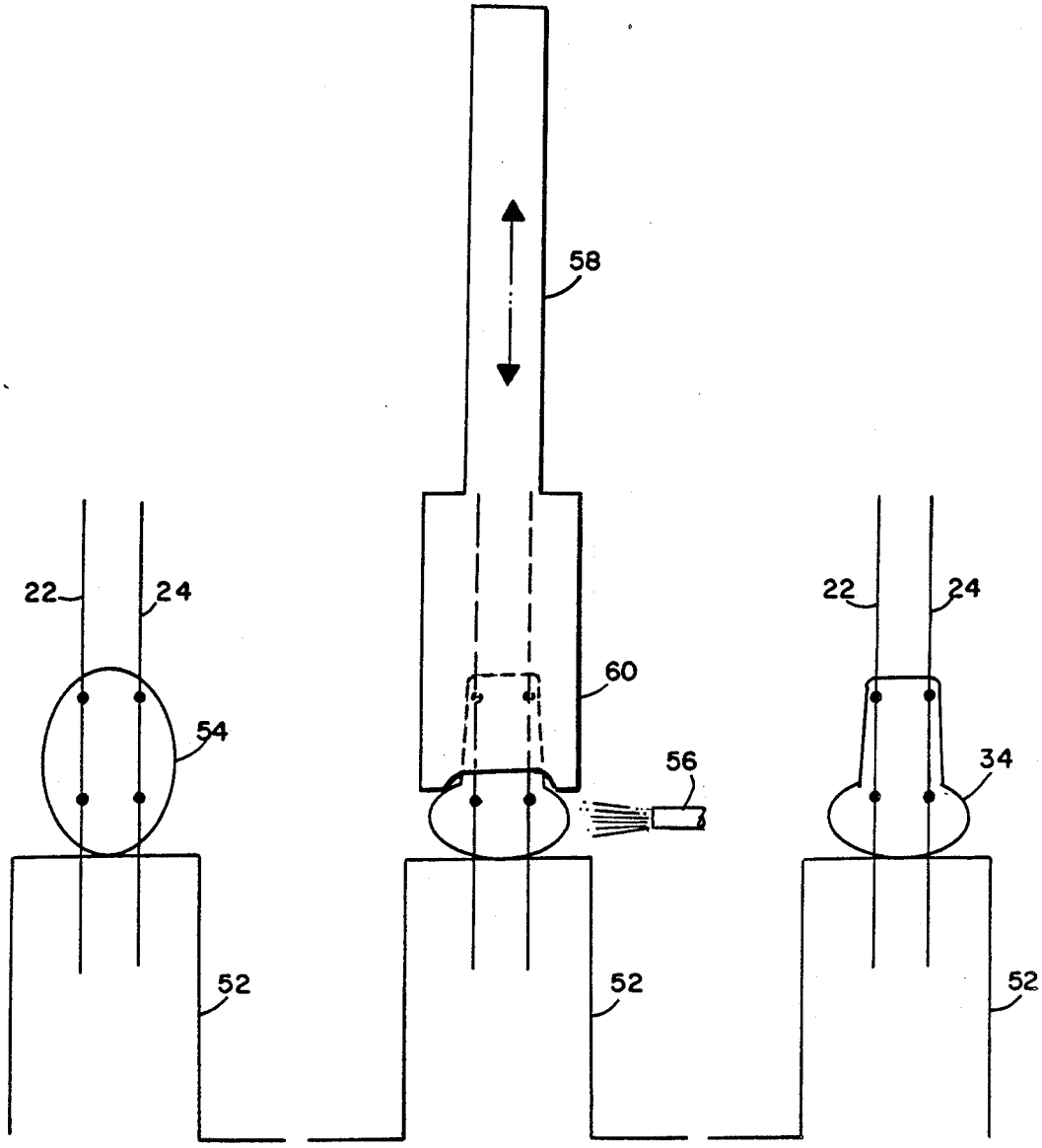
FIGS. 10*a*, 10*b* AND 10*c* are elevational views of steps in manufacturing the mount of the present invention.

FIGS. 10*a*, 10*b* and 10*c* are elevational views illustrating the steps in manufacturing the mount of the present invention. In FIG. 10*a*, a pair of lead-in conductors 22, 24 are held in a substantially parallel relationship by a jig 52. A glass bead 54 is formed on the lead-in conductors. In FIG. 10*b*, the glass bead is heated to its softening point by means of a torch 56. Thereafter, a tubular-shaped forming tool 58 moving in a downward direction to the top surface of jig 52 engages the softened glass bead. The lower end portion 60 of forming tool 58 provides a mold to shape the glass bead into the desired shape (e.g., with a disk-shaped portion and a projecting planar portion). Finally, forming tool 58 is moved upward and removed from the mount. A bimetallic element may be attached to one or both of the lead-in conductors either before or after the mount is formed. The mount is eventually sealed to a suitable envelope by means of a press seal. The envelope is processed in a conventional manner by exhausting, filling with an ionizable medium (in the case of a glow discharge starter) and hermetically sealing by tipping off the upper portion of the envelope.

In a non-limiting example of the present invention, the internal radius R2 of the envelope is about 0.110 inch (5.6 mm), the radius R1 of disk-shaped portion 42 is chosen from about 0.098 to 0.102 inch which allows a clearance distance of from 0.008–0.012 inch. The length of the lower planar portion of the stem is about 0.291 inch (7.39 mm). The distance between the pair of substantially parallel surfaces 46, 48 is equal to about 0.065 inch (1.67 mm). The depth of the lower planar portion is about 0.163 inch (4.14 mm). The lead-in conductor includes three segments in which the diameter of the portion of the lead-in conductor associated with the planar portion is 0.016 inch (0.41 mm).

There has thus been shown and described an improved thermal device, mount and method of manufacturing each. The invention provides an improved thermal device wherein the electrodes are properly centered so that the electrodes are prevented from touching the internal surface of the envelope. The thermal device can be manufactured without forming oxidation on the bimetallic element. The manufacturing method described prevents softening of the upper portion of the glass stem during sealing so that the bimetallic element does not press against the counter electrode causing distortion in the parallel relationship of the electrodes.

While there have been shown and described what are at present considered to be the preferred embodiments of the invention, it will be apparent to those skilled in the art that various changes and modifications can be made herein without departing from the scope of the invention. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A thermal device comprising:

an envelope having a predetermined internal radius; and a mount within said envelope and including a glass stem sealed to one end of said envelope and a pair of lead-in conductors passing through said glass stem and forming a bimetallic electrode and a counter electrode within said envelope, said glass stem including a transverse portion extending substantially across said envelope and having a predetermined radius and a longitudinally-extending planar portion projecting from said transverse portion, said transverse portion being sufficient to eliminate formation of oxide on said bimetallic electrode during sealing.

2. The thermal device of claim 1 wherein said transverse portion is disk-shaped.

3. The thermal device of claim 1 wherein said transverse portion of said glass stem lies in a plane substantially perpendicular to said lead-in conductors.

4. The thermal device of claim 2 wherein said predetermined radius of said transverse portion of said glass stem is within the range of from about 89 to 93 percent of said predetermined internal radius of said envelope.

5. The thermal device of claim 1 wherein said planar portion of said glass stem has a pair of substantially parallel surfaces spaced a predetermined distance therapart and lying in respective planes parallel to a plane passing through said lead-in conductors.

6. The thermal device of claim 5 wherein said predetermined distance between said pair of substantially parallel surfaces is not greater than about four times the diameter of the portion of said lead-in conductors associated with said planar portion of said glass stem.

7. The thermal device of claim 1 further including an ionizable medium.

8. A mount for sealing into an envelope with a predetermined internal radius comprising:

a glass stem including a disk-shaped transverse portion having a predetermined radius and a longitudinally-extending planar portion a pair of lead-in conductors passing through said glass stem and forming a bimetallic electrode and a counter electrode projecting from said transverse portion, said disk-shaped transverse portion being sufficient to eliminate formation of oxide on said bimetallic electrode during sealing of said mount to said envelope.

9. The mount of claim 8 wherein said transverse portion of said glass stem lies in a plane substantially perpendicular to said lead-in conductors.

10. The mount of claim 8 wherein said predetermined radius of said transverse portion is within the range of from about 89 to 93 percent of said predetermined internal radius of said envelope.

11. The mount of claim 8 wherein said planar portion of said glass stem is provided with a pair of substantially parallel surfaces spaced a predetermined distance thereapart and lying in respective planes parallel to a plane passing through said lead-in conductors.

12. The mount of claim 11 wherein said predetermined distance between said pair of substantially parallel surfaces being not greater than about four times the diameter of the portion of said lead-in conductors associated with said planar portion of said glass stem.

13. The mount of claim 8 wherein a bimetallic element is attached to at least one of said lead-in conductors.

14. A glow discharge device comprising:

a tubular envelope having a predetermined internal radius and enclosing an ionizable medium; and a mount within said envelope and including a glass stem sealed to one end of said envelope and a pair of lead-in conductors passing through said glass stem and forming a bimetallic electrode and a counter electrode within said envelope, said glass stem including a transverse portion extending substantially across said envelope and having a predetermined radius and a longitudinally-extending planar portion projecting from said transverse portion, said transverse portion being sufficient to eliminate formation of oxide on said bimetallic electrode during sealing.

15. The glow discharge starter of claim 14 wherein said transverse portion of said glass stem is disk-shaped.

16. The glow discharge starter of claim 15 wherein said disk-shaped portion has a radius of from about 89 to 93 percent of the predetermined internal radius of said tubular envelope.

* * * * *

UNITED STATES PATENT AND TRADEMARK OFFICE

CERTIFICATE OF CORRECTION

PATENT NO. : 4,970,425

DATED : November 13, 1990

INVENTOR(S) : Nikolaos Barakitis

It is certified that error appears in the above—identified patent and that said Letters Patent is hereby corrected as shown below:

In column 6, claim 8, line 46, after "portion" insert --projecting from said transverse portion,--.

In column 6, claim 8, line 49, delete "projecting from said transverse portion".

Signed and Sealed this

Twenty-fifth Day of February, 1992

*Attest:*

HARRY F. MANBECK, JR.

*Attesting Officer*

*Commissioner of Patents and Trademarks*